US009528199B2

(12) United States Patent
Journée et al.

(10) Patent No.: US 9,528,199 B2
(45) Date of Patent: Dec. 27, 2016

(54) METHOD AND APPARATUS FOR ENTANGLING YARNS

(71) Applicant: TEIJIN ARAMID B.V., Arnhem (NL)

(72) Inventors: Marinus Journée, Loo (NL); Karel Johannes Van Assenbergh, Twist (DE)

(73) Assignee: TEIJIN ARAMID B.V., Arnhem (NL)

( * ) Notice: Subject to any disclaimer, the term of this patent is extended or adjusted under 35 U.S.C. 154(b) by 255 days.

(21) Appl. No.: 14/379,857

(22) PCT Filed: Feb. 11, 2013

(86) PCT No.: PCT/EP2013/052637
§ 371 (c)(1),
(2) Date: Aug. 20, 2014

(87) PCT Pub. No.: WO2013/124177
PCT Pub. Date: Aug. 29, 2013

(65) Prior Publication Data

US 2015/0259831 A1 Sep. 17, 2015

(30) Foreign Application Priority Data

Feb. 20, 2012 (EP) ..... 12156165

(51) Int. Cl.

| | |
|---|---|
| ***D02J 1/08*** | (2006.01) |
| ***D02G 1/16*** | (2006.01) |
| ***D02G 1/20*** | (2006.01) |
| ***D02J 1/18*** | (2006.01) |
| ***D01H 4/04*** | (2006.01) |
| ***D02G 3/22*** | (2006.01) |

(52) U.S. Cl.
CPC . *D02J 1/08* (2013.01); *D01H 4/04* (2013.01); *D02G 1/16* (2013.01); *D02G 1/20* (2013.01); *D02G 3/22* (2013.01); *D02J 1/18* (2013.01)

(58) Field of Classification Search
CPC ..... D02J 1/08; D02J 1/02; D02J 1/18; D02G 1/16; D02G 1/161; D02G 1/168; D02G 1/20; D01H 4/02; B65H 69/061; B65H 69/06; D07B 7/169
USPC ..... 28/209, 210, 211, 271, 273, 275; 57/22, 57/23
See application file for complete search history.

(56) References Cited

U.S. PATENT DOCUMENTS 3,013,379 A * 12/1961 Breen ..... D02G 1/165 264/DIG. 77
4,419,859 A * 12/1983 Mima ..... B65H 69/061 57/22
4,432,194 A * 2/1984 Luz ..... B65H 69/061 57/22

(Continued)

FOREIGN PATENT DOCUMENTS

EP 2 348 143 A1 7/2011
GB 1 564 885 A 4/1980

OTHER PUBLICATIONS

International Search Report issued in International Application No. PCT/EP2013/052637 dated Apr. 9, 2013.

(Continued)

*Primary Examiner* — Amy Vanatta
(74) *Attorney, Agent, or Firm* — Oliff PLC

(57) ABSTRACT

A fluid jet is directed onto a first yarn at least at sonic speed to entangle the first yarn, which is aligned substantially parallel to a main yarn, into the main yarn enabling that yarns having a high yarn count and/or wet yarns can be entangled.

15 Claims, 1 Drawing Sheet

(56) References Cited

U.S. PATENT DOCUMENTS

| | | | | | |
|---|---|---|---|---|---|
| 4,498,279 | A * | 2/1985 | Pavek | B65H 69/061 | 57/22 |
| 4,498,280 | A * | 2/1985 | Pavek | B65H 69/061 | 57/22 |
| 4,965,916 | A * | 10/1990 | Artunc | D02J 1/08 | 28/271 |
| 5,040,276 | A * | 8/1991 | Coons, III | D02G 1/168 | 28/220 |
| 5,640,745 | A | 6/1997 | Bertsch et al. | | |
| 6,564,438 | B1 * | 5/2003 | Bertsch | D02G 1/162 | 28/271 |
| 2003/0089098 | A1 * | 5/2003 | Bodmer | D02G 1/165 | 57/245 |
| 2003/0110754 | A1 * | 6/2003 | Simmen | D02G 1/04 | 57/289 |
| 2006/0064859 | A1 * | 3/2006 | Bertsch | D02J 1/08 | 28/271 |
| 2007/0107410 | A1 * | 5/2007 | Bertsch | D02G 1/161 | 57/350 |
| 2011/0217228 | A1 * | 9/2011 | Mishima | B65H 69/06 | 423/447.1 |

OTHER PUBLICATIONS

Written Opinion of the International Searching Authority issued in International Application No. PCT/EP2013/052637 dated Apr. 9, 2013.

* cited by examiner

METHOD AND APPARATUS FOR ENTANGLING YARNS

This disclosure pertains to a method for entangling a yarn into a main yarn. Furthermore, this disclosure pertains to an apparatus for entangling a yarn into a main yarn.

BACKGROUND

In yarn spinning equipment producing multiple yarns simultaneously, it can happen that the movement of a yarn is interrupted, for example when a spinneret plate is being exchanged or when a yarn breaks. When starting or resuming the production of the yarn there are different ways to (re)introduce the yarn through the spinning line up to the winder. An operator may for example use an aspirator, which applies suction to the yarn to remove excess length of yarn, to manually guide the yarn through the spinning line and bring the yarn to the winder. However, this method produces a lot of waste material as excess length of yarn is removed, especially for processes spinning yarns at high speeds. Furthermore, there is a risk that the operator disturbs the movement of neighboring yarns resulting in even more waste material.

Alternatively, the yarn to be introduced into the spinning line can be connected to a neighboring moving yarn, which has already been introduced through the spinning line up to the winder. The moving yarn then guides the yarn to be introduced to the winder, where both yarns can be separated again, either manually by an operator or automatically by a device to split the yarns, so that each yarn can be wound separately. The connection of the yarn to be introduced into the spinning line to the moving neighboring yarn can be obtained by entangling the yarn to be introduced into the moving yarn. The level of waste is reduced as the yarn is (re)introduced through the spinning line at the actual speed of the neighboring yarn and the risk of disturbing the movement of other yarns is reduced.

Entangling of a first yarn into a main yarn is a method which is used to connect two yarns to each other without the requirement of applying a knot, an adhesive or a thermal bonding agent, or applying a twist to the yarns. A fluid jet directed to one or both yarns separates filaments and/or groups of filaments in the first yarn from each other and then intermingles the filaments and/or groups of filaments of the first yarn with filaments and/or groups of filaments of the main yarn to form mechanical friction points between filaments and/or groups of filaments from both yarns in order to obtain a connection between both yarns.

When both the first yarn and the main yarn are stagnant, i.e. not moving, the size of the entangled section of the yarns and the strength of the connection between the yarns can be controlled by selecting the appropriate size of the fluid jet and the duration of directing the fluid jet onto the first yarn. However, when the first yarn is stagnant and the main yarn is moving or when both yarns are moving, it is difficult to control the size and strength of the connection between the yarns.

When the yarn count of the yarns to be connected increases, it becomes increasingly difficult to obtain a sufficiently strong connection between the yarns, especially when one yarn is moving or when both yarns are moving. The yarn count is a measure of the thickness of the yarn and is determined in dtex, i.e. the weight of the yarn in grams per 10,000 m of yarn length, and which is equal to the number of filaments in the yarn multiplied by dtex per filament (dpf), i.e. the weight of the filament in grams per 10,000 m of filament length.

When one or both yarns are wet it becomes difficult to obtain a sufficiently strong connection between the yarns as the effective weight of the filaments and/or filament groups in the wet yarn is increased and the coherent forces between the filaments and/or filament groups of the wet yarn hinders the action of the fluid jet to separate filaments and/or groups of filaments in the wet yarn.

SUMMARY

It is an object to provide an improved method of entangling a yarn into a moving main yarn, in particular for entangling yarns having high yarn counts and/or for entangling wet yarns.

The object is achieved by a method of entangling a first yarn into a moving main yarn comprising the steps of aligning the first yarn substantially parallel to the main yarn, and subsequently directing a fluid jet onto the first yarn for separating filaments and/or groups of filaments in the first yarn from each other and to intermingle filaments and/or groups of filaments of the first yarn with filaments and/or groups of filaments of the main yarn to form mechanical friction points between filaments and/or groups of filaments from the first yarn and the main yarn wherein the fluid jet is directed onto the first yarn at least at sonic speed.

Surprisingly, it has been found that when a fluid jet is directed onto the first yarn at least at sonic speed, it is possible to entangle yarns having high yarn counts and to entangle wet yarns enabling that yarns having high yarn counts and/or wet yarns can be (re)introduced into the spinning line at the speed of a neighboring yarn, which reduces the amount of waste generated and/or the number of operators required during yarn production. The sonic speed is understood to be the speed of sound at sea level at 20° C.

DETAILED DESCRIPTION

Figure 1:
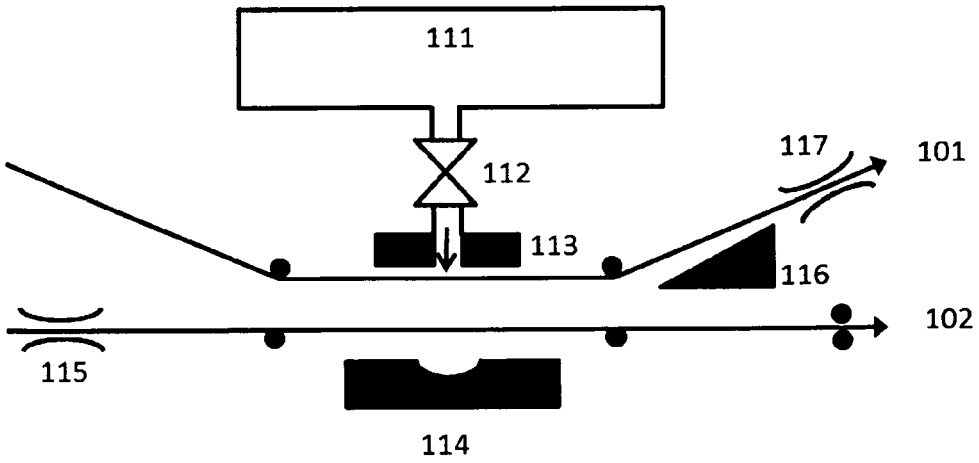
FIG. 1 schematically represents an apparatus according to an embodiment.

In an embodiment, the method of entangling a first yarn into a main yarn comprises the step of directing multiple fluid jets onto the first yarn, wherein each fluid jet is directed onto the first yarn at least at sonic speed.

The method may also be used to entangle more than one yarn into a main yarn. In a preferred embodiment, the method is used to entangle both a first yarn and a second yarn into a main yarn to form a connection between the three yarns.

In an embodiment, the method of entangling yarns into a main yarn comprises the step of directing multiple fluid jets onto each yarn to be entangled into the main yarn, wherein each fluid jet is directed onto the yarns at least at sonic speed.

The speed of the first yarn and/or the tension on the first yarn may be set to a desired value before directing the fluid jet onto the first yarn, for example by winding the first yarn onto a separate winder, which is preferably located in close vicinity of the fluid jet.

When the fluid jet is directed onto the first yarn to entangle the first yarn into the main yarn, the first yarn is effectively divided into two parts, i.e. the leading part and the trailing part of the first yarn. The trailing part of the first yarn is the part of the first yarn which is to be guided by the main yarn to the winder at the end of the spinning line. The trailing part of the first yarn is thus the part of the first yarn between the spinning plate and the entangled connection with the main yarn. The leading part of the first yarn is the part of the first yarn which has been wound onto the separate winder and which is generally considered waste material. The leading part of the first yarn is thus the part of the first yarn between the separate winder and the entangled connection with the main yarn. The main yarn is also effectively divided into two parts, i.e. the leading part and the trailing part of the main yarn. The trailing part of the main yarn is the part of the main yarn which is to be guided to the winder at the end of the spinning line. The speed of main yarn before and after entangling remains essentially the same. The trailing part of the main yarn is thus the part of the main yarn between the spinning plate and the entangled connection with the first yarn. The leading part of the main yarn is the part of the main yarn which is being wound onto the winder at the end of the spinning line. The leading part of the main yarn is thus the part of the main yarn between the winder at the end of the spinning line and the entangled connection with the first yarn.

When the first yarn is entangled into the main yarn, both the trailing part and the leading part of the first yarn may be guided to the end of the spinning line by the leading part of the main yarn. Preferably, the method comprises the step of cutting off the leading part of the first yarn after the connection between the first yarn and the main yarn is formed to prevent that the leading part of the first yarn disturbs neighboring yarns in the spinning line. The leading part of the first yarn can be cut off by any known means to cut a yarn, such as for example a pneumatic driven cutter or a static knife. Preferably, the leading part of the first yarn is be cut off by a static knife.

The method may be particularly advantageous to entangle yarns having a high yarn count, based on the weight of dry polymer, especially when at least one of the yarns has a yarn count of at least 100 dtex, preferably at least 150 dtex, more preferably at least 500 dtex, most preferably at least 1000 dtex. Although the maximum yarn count is not intrinsically restricted, the method is especially advantageous to entangle yarns having a yarn count of at most 10,000 dtex, preferably at most 5000 dtex, most preferably at most 3360 dtex.

The method according may be particularly advantageous to entangle yarns wherein the individual filaments in the yarns to be connected have a dtex per filament, based on the weight of dry polymer, of at least 0.2 dtex, more preferably at least 0.3 dtex, most preferably at least 0.5 dtex. Although the maximum dtex per filament is not intrinsically restricted, the method is especially advantageous to entangle yarns having filaments with a dtex per filament of 10 dtex or less, preferably 7.5 dtex or less, most preferably 5 dtex or less.

The speed of the main yarn may be varied widely in the method. However, the method may be especially advantageous when the speed of the main yarn is at least 10 m/min, preferably at least 100 m/min, more preferably at least 200 m/min, even more preferably at least 300 m/min, most preferably at least 400 m/min. The fact that the fluid jet is directed onto the first yarn at least at sonic speed enables that sufficient entanglement is achieved even when the main yarn moves at high speeds. Although the maximum speed of the main yarn in the method is not restricted, it is preferred that the speed of the main yarn is 1500 m/min or less, more preferably 1200 m/min or less, even more preferably 900 m/min or less, most preferably 600 m/min or less.

The speed of the first yarn, and optional further yarns, to be entangled into the main yarn may also be varied widely in the method. However, the method is especially advantageous when the speed of the first yarn, and/or each optional further yarn, is at least 20% of the speed of the main yarn, preferably at least 50%, more preferably at least 90%, even more preferably at least 100%, most preferably at least 105% of the speed of the main yarn. Preferably, the speed of the first yarn, and/or each optional further yarn, is 150% or less of the speed of the main yarn, preferably 130% or less of the speed of the main yarn, more preferably 120% or less of the speed of the main yarn. Most preferably the speed of the first yarn, and/or each optional further yarn, is equal to the speed of the main yarn.

Any fluid substantially inert to the yarn may be applied in the fluid jet(s) in the method. It is especially advantageous when a compressible fluid is applied in the method as a compressible fluid is less prone to reduction in speed in an advancing fluid jet than a substantially non-compressible fluid. Preferably, the fluid applied in the fluid jet(s) is air.

The yarns may comprise filaments made from any polymer suitable for spinning filaments. However, the method may be especially advantageous to entangle yarns from high performance polymers including, but not limited to, aromatic polyamides, also known as aramids, such as for example meta-aramids, para-aramids or copolymers thereof, and high molecular weight polyethylene, especially ultra high molecular weight polyethylene. The method may be particularly advantageous to entangle yarns spun from a solution comprising the polymer and a solvent, such as for example yarns comprising filaments made of an aramid, more preferably a para-aramid, most preferably poly(paraphenylene terephthalamide) (PPTA). Aramid yarns are generally spun from a liquid spin-dope solution, which comprises the fiber forming aramid polymer and a suitable solvent, such as for example a mixture of a polar amide solvent selected from N-methyl-2-pyrrolidone, N,N'-dimethylformamide, N,N'-dimethylacetamide, tetramethylurea, and mixtures thereof, water, and an alkali or alkaline earth metal chloride, such as calcium chloride ($CaCl_2$) or lithium chloride (LiCl), or sulfuric acid. Preferably, the solvent is sulfuric acid. The aramid filaments of the yarns in the spinning line may still comprise liquid solvent. Alternatively, the aramid filaments may have been washed with a washing fluid, preferably water, to remove the liquid solvent, and the aramid filaments may still comprise washing fluid.

The method according may be especially advantageous to entangle a wet yarn comprising at least 10 wt. % of a liquid, based on the weight of polymer in the yarn, into a main yarn. Preferably, the wet yarn comprises at least 50 wt. %, more preferably at least 100 wt. %, most preferably at least 150 wt. % of a liquid, based on the weight of polymer in the yarn. Preferably, the wet yarn comprises 500 wt. % or less, preferably 400 wt. % or less, more preferably 300 wt. % or less, most preferably 200 wt % or less of a liquid, based on the weight of polymer in the yarn. When entangling a wet yarn into a main yarn, the method may comprise the step of applying suction to remove any aerosol formed by directing the fluid jet onto the wet yarn. The main yarn may also be a wet yarn as described above.

To obtain a sufficiently strong connection between the first yarn, and optional further yarns, and the main yarn, it is preferred that the fluid jet(s) is (are) directed onto the first yarn, and optional further yarns, for a time period of at least 0.1 seconds, more preferably at least 0.15 seconds, most preferably at least 0.2 seconds. Although the fluid jet(s) may be directed onto the first yarn, and optional further yarns, for a prolonged period of time, it is preferred that the fluid jet(s) is (are) directed onto the first yarn for a time period of 1.0 seconds or less, more preferably 0.5 seconds or less, most preferably 0.3 seconds or less to reduce the noise generated by the fluid jet(s) during production of the yarns.

The fluid jet is preferably generated by releasing a compressed fluid from a receptacle, such as a pressure vessel or a pressure cylinder, containing the compressed fluid. Preferably the pressure of the compressed fluid in the pressure vessel is at least 5 bar, more preferably at least 7.5 bar, even more preferably at least 10 bar, most preferably at least 15 bar in order to generate a fluid jet at least at sonic speed. By adjusting the pressure of the compressed fluid, the fluid jet directed onto the first yarn can be optimized for optimum strength of the connection between the first yarn and the main yarn. The release of a pulse of the compressed fluid to form a fluid jet generates sufficient impulse to entangle even yarns with high yarn counts and/or wet yarns.

To further improve the strength of the connection between the first yarn, and optional further yarns, and the main yarn, the fluid jet(s) may be reflected by suitable reflecting means, such as for example by a plate having a flat surface or by a plate comprising one or more concave sections, after having intermingled filaments and/or groups of filaments of the first yarn, and optional further yarns, with filaments and/or groups of filaments of the main yarn, such that the fluid jet(s) is (are) redirected onto the main yarn for separating filaments and/or groups of filaments in the main yarn from each other and to intermingle filaments and/or groups of filaments of the main yarn with filaments and/or groups of filaments of the first yarn, and optional further yarns, to form mechanical friction points between filaments and/or groups of filaments from the main yarn and the first yarn, and optional further yarns.

The tension on the main yarn may vary widely in the method. The fact that the fluid jet is directed onto the first yarn at least at sonic speed enables that sufficient entanglement is achieved even when the main yarn is under high tension, as may be imposed due to other processing requirements of the spinning line.

The tension on the first yarn, and optional further yarns, to be entangled into the main yarn may also vary widely in the method. However, the method may be especially advantageous when the tension on the first yarn, and/or each optional further yarn, is equal to or less than the tension on the main yarn to ensure that the leading part of the first yarn, and/or of each optional further yarn, is cut off by the cutting means, such as for example a static knife. Preferably, the tension on the first yarn, and/or each optional further yarn, is 95% or less of the tension on the main yarn, more preferably 90% or less, most preferably 75% or less of the tension on the main yarn. As the tension on the main yarn exceeds the tension on the first yarn, and/or each optional further yarn, the main yarn will not be in direct contact with the cutting means. Instead, the first yarn, and/or each optional further yarn, contacts the cutting means directly in order to cut off the leading part of the first yarn, and/or each optional further yarn.

In an embodiment, the distance between the first yarn and the main yarn is 10 mm or less to obtain improved control over the strength of the connection between the first yarn and the main yarn. Preferably, the distance between the first yarn and the main yarn is 5 mm or less, more preferably 3 mm or less. When more than one yarn is entangled into the main yarn, the distance between each of the yarns to be entangled into the main yarn and the main yarn is preferably 10 mm or less, more preferably 5 mm or less, most preferably 3 mm or less.

It is another object to provide an apparatus for entangling a yarn into a main yarn, in particular for entangling yarns having high yarn counts and/or for entangling wet yarns.

The object is achieved by an apparatus for entangling a first yarn into a main yarn comprising a means for aligning the first yarn substantially parallel to the main yarn, a means for generating a fluid jet directed onto the first yarn for separating filaments and/or groups of filaments in the first yarn from each other and to intermingle filaments and/or groups of filaments of the first yarn with filaments and/or groups of filaments of the main yarn to form mechanical friction points between filaments and/or groups of filaments from the first yarn and the main yarn wherein the means for generating a fluid jet generates a fluid jet at least at sonic speed when in use. The apparatus is capable of carrying out the method for entangling a first yarn into a main yarn, in particular for entangling yarns having high yarn counts and/or for entangling wet yarns.

Preferably, the means for generating the fluid jet comprises a receptacle, for example a pressure vessel or a pressure cylinder, for containing a compressed fluid and a valve for releasing a pulse of compressed fluid in the direction of the first yarn. The receptacle is preferably located within 1 m from the first yarn, more preferably within 0.5 m, most preferably within 0.3 m from the first yarn, to minimize loss of speed in the fluid jet, for example due to friction in tubing between the source of compressed fluid and the first yarn. A further advantage of the receptacle being located in the direct vicinity of the first yarn is that the time delay between opening of the valve and obtaining a connection between the first yarn and the main yarn by entanglement is reduced, which improves the control over the entangling method.

The means for generating the fluid jet preferably comprises a control unit to control the time period during which the fluid jet is directed onto the first yarn. Preferably, the time period during which the fluid jet is directed onto the first yarn is controlled to be at least 0.1 seconds, more preferably at least 0.15 seconds, most preferably at least 0.2 seconds. Although, the fluid jet(s) may be directed onto the first yarn, and optional further yarns, for a prolonged period of time, it is preferred that the time period during which the fluid jet is directed onto the first yarn is controlled to be 1.0 seconds or less, more preferably 0.5 seconds or less, most preferably 0.3 seconds or less to reduce the noise generated by the fluid jet(s) during production of the yarns.

The means for generating the fluid jet preferably comprises a second valve for replenishing the amount of compressed fluid in the receptacle after release of the fluid jet.

When in use, the pressure of the compressed fluid in the receptacle is preferably at least 5 bar, more preferably at least 7.5 bar, even more preferably at least 10 bar, most preferably at least 15 bar in order to generate a fluid jet at least at sonic speed. By adjusting the pressure of the compressed fluid, the speed and impulse of the fluid jet directed onto the first yarn can be adjusted for optimum strength of the connection between the first yarn and the main yarn.

The pulse of compressed fluid released by the valve comprised in the means for generating the fluid jet may be directed in the direction of the first yarn through a body comprising a channel. The channel is connected to the valve for releasing a pulse of compressed fluid. The channel may have any cross sectional shape. Preferably, the cross section of the channel is circular to minimize friction between the compressed fluid and the wall of the channel. The channel preferably has an effective diameter of at least 0.3 mm, more preferably at least 0.5 mm, most preferably at least 0.75 mm to enable that yarns having a high yarn count and/or wet yarns can be entangled. The effective radius of the channel is to be understood to be the diameter of a circular channel having the same cross sectional area as the actual channel. In a preferred embodiment, the cross sectional area of the channel increases with increasing distance from the valve to form an expanding channel, which enables a further increase of the speed of the fluid jet. Preferably, the smallest effective diameter is at least 0.3 cm, more preferably at least 0.5 cm, even more preferably at least 0.7 cm, most preferably 0.8 cm. The fluid jet has a speed of at least the sonic speed in the smallest cross sectional area of the channel.

The means for generating the fluid jet may comprise further valves for releasing multiple pulses of compressed fluid in the direction of the first yarn and/or for releasing multiple pulses of compressed fluid in the direction of multiple yarns to be entangled into the main yarn. Alternatively, the pulse of compressed fluid released by the valve comprised in the means for generating the fluid jet may be directed through multiple channels in the direction of the first yarn and/or in the direction of further yarns to be entangled into the main yarn.

Preferably, the receptacle for containing the compressed fluid has a volume of at least 0.5 liter, more preferably at least 1.0 liter, most preferably at least 1.25 liter to provide a sufficient amount of compressed fluid for generating a fluid jet for a sufficient time period.

The valve for releasing a pulse of compressed fluid in the direction of the first yarn, may continuously release a small amount of compressed fluid during the time period wherein there is no fluid jet generated to avoid that contamination enters the channel, for example when applying the method to a wet yarn, for example comprising liquid solvent or washing liquid.

The apparatus for entangling a first yarn into a main yarn may further comprise suction means, such as for example an aspirator or an airmover, to remove aerosol, for example aerosol formed by directing the fluid jet onto a wet yarn.

The apparatus for entangling a first yarn into a main yarn preferably comprises yarn guides to align the first yarn substantially parallel to the main yarn. The yarn guides prevent that the main yarn and the first yarn come into contact with each other spontaneously, i.e. without directing a fluid jet onto the first yarn, which may cause uncontrolled sticking together of yarns which may disturb neighboring yarns.

The apparatus for entangling a first yarn into a main yarn may further comprise yarn guides to align a second yarn, and optional further yarns, substantially parallel to the main yarn.

Preferably, the yarn guides are capable of aligning the first yarn substantially parallel to the main yarn at a distance of less than 10 mm, more preferably less than 5 mm, most preferably less than 3 mm from the main yarn. When more than one yarn is to be entangled into the main yarn, the yarn guides are preferably capable of aligning each of the yarns to be entangled into the main yarn at a distance to the main yarn of less than 10 mm, more preferably less than 5 mm, most preferably less than 3 mm from the main yarn.

The speed of the main yarn may vary widely and is generally determined by other requirements of the spinning process and/or by other equipment in the spinning line. The apparatus for entangling a first yarn into a main yarn may comprise means for adjusting the tension on the main yarn. Preferably, the means for adjusting the tension on the main yarn is capable of controlling the tension on the main yarn to be equal or higher than the tension on the first yarn. The means for adjusting the tension on the main yarn can be any known means to increase the tension in a yarn, such as for example an adjustable yarn brake.

The speed of the first yarn to be (re)introduced into the spinning line can be adjusted for obtaining a sufficiently strong connection between the first yarn and the main yarn. When aligning the first yarn substantially parallel to the main yarn, the first yarn may be wound on a separate winder, which is preferably located in the direct vicinity of the apparatus for entangling a first yarn into a main yarn. Most preferably, the winder for winding the first yarn during alignment with the main yarn prior to directing the fluid jet onto the first yarn is directly connected to the apparatus for entangling a first yarn into a main yarn. Preferably, the winder is capable of winding the first yarn at a speed of least 20% of the speed of the main yarn, preferably at least 50%, more preferably at least 90%, even more preferably at least 100%, most preferably at least 105% of the speed of the main yarn. Preferably, the winder is capable of winding the first yarn at a speed of 150% or less of the speed of the main yarn, more preferably 130% or less of the speed of the main yarn, even more preferably 120% or less of the speed of the main yarn. Most preferably, the winder is capable of winding the first yarn at a speed equal to the speed of the main yarn.

The apparatus for entangling a first yarn into a main yarn may further comprise means for adjusting the tension on the first yarn, and optional further yarns, to be entangled into the main yarn. Preferably, the means for adjusting the tension on the first yarn, and optional further yarns, is capable of controlling the tension on the first yarn, and optional further yarns, to be 95% or less of the tension on the main yarn, more preferably to 90% or less, most preferably to 75% or less of the tension on the main yarn to improve the strength of the connection between the first yarn, and optional further yarns, and the main yarn. The means for adjusting the tension on the first yarn, and optional further yarns, can be any known means for reducing the tension in a yarn, such as for example an adjustable yarn brake.

The apparatus for entangling a first yarn into a main yarn may further comprise means for cutting off the leading part of the first yarn, and optional further yarns, such as for example a pneumatic driven cutter or a static knife. Preferably, the means for cutting off the leading part of the first yarn is a static knife, especially for cutting off the leading part of the first yarn at a high speed of the main yarn.

Preferably, the means for adjusting the tension on the first yarn, and/or on each optional further yarn, and the means for adjusting the tension on the main yarn are configured such that the tension on the first yarn, and/or on each optional further yarn, can be adjusted to be equal to or less than the tension on the main yarn to ensure that the leading part of the first yarn, and/or of each optional further yarn, is cut off by the cutting means. More preferably, the tension on the first yarn, and/or each optional further yarn, is 95% or less of the tension on the main yarn, even more preferably 90% or less, most preferably 75% or less of the tension on the main yarn.

When the tension on the main yarn, controlled by the means for adjusting the tension on the main yarn, exceeds the tension on the first yarn, controlled by the means for adjusting the tension on the first yarn, the leading part of the first yarn will contact the cutting means directly, which thus will cut off the leading part of the first yarn while the main yarn is moving in the direction of the winder at the end of the spinning line without being in contact with the cutting means.

The apparatus for entangling a first yarn into a main yarn may further comprise means for reflecting the fluid jet(s) after having intermingled filaments and/or groups of filaments of the first yarn, and optional further yarns, with filaments and/or groups of filaments of the main yarn. The means for reflecting the fluid jet(s) may comprise at least one plate located opposite to the side from which the fluid jet(s) is/are directed onto the first yarn, and optional further yarns. When the means for reflecting the fluid jet(s) comprises more than one plate, each plate is preferably located opposite to the side from which one or more fluid jet(s) is/are directed onto the first yarn or optional further yarns. Preferably, each plate is located within 10 mm from the body comprising the channel(s) for directing the fluid jet(s), more preferably within 8 mm, most preferably within 6 mm from the body comprising the channel(s) for directing the fluid jet(s) to optimize the strength of the connection between the first yarn, and optional further yarns, and the main yarn. Each plate may have a flat surface, the surface preferably being parallel to the main yarn. Preferably, each plate has at least one concave section for reflecting the fluid jet(s) to reduce loss of speed in the fluid jet when reflecting the fluid jet. Each plate may comprise multiple concave sections for reflecting multiple fluid jets.

Referring to FIG. 1, a first yarn 101 is aligned substantially parallel to main yarn 102 moving in the direction of the arrow. The receptacle 111 comprises a compressed fluid, which is released by valve 112 through a channel in body 113 to form a fluid jet directed onto first yarn 101. The fluid jet has not yet reached the first yarn 101, the first yarn 101 has thus not yet been entangled into the main yarn 102. The fluid jet can be reflected by plate 114 comprising a concave section. The tension on the main yarn 102 can be increased by yarn brake 115. The tension on the first yarn 101 can be reduced by yarn brake 117. The apparatus comprises static knife 116 to cut off the leading part of the first yarn 101.

Figure 2:
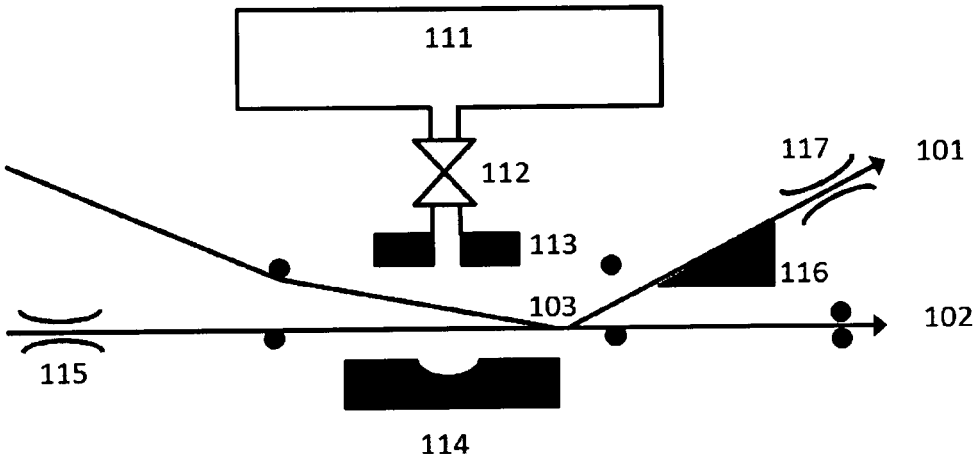
FIG. 2 schematically represents an apparatus according to an embodiment.

Referring to FIG. 2, the first yarn 101 has just been entangled into the main yarn 102 to form a connection 103 between the first yarn 101 and the main yarn 102. The tension on the main yarn 102, controlled by yarn brake 115, exceeds the tension on the first yarn 101, controlled by yarn brake 117, which causes the first yarn 101 to contact the static knife 116 directly, which thus will cut off the leading part of the first yarn 101 as main yarn 102 is moving in the direction of the arrow.

Examples

A first yarn was entangled into main yarn using the method and the apparatus according to the above-described aspects. Both the first yarn and the main yarn were made of para-aramid and were of the type known as Twaron® D2200 as sold by Teijin Aramid B.V., The Netherlands. Both the first yarn and the main yarn comprised a fluid content between 0 and 500 wt. % (e.g. 100 wt. % of water). The fluid jet was directed onto the first yarn for a time period of 0.2 seconds and the pressure of the compressed air in the receptacle was 11 bar to successfully obtain a sufficiently strong connection between the first yarn and the main yarn in order for the first yarn to be guided by the main yarn to the winder at the end of the spinning line. The yarn count of the first yarn and the main yarn, the speed of the first yarn and the main yarn, and/or the tension on the first yarn and the main yarn have been varied as shown in Table 1.

TABLE 1

| Example | | Yarn Count (dtex) | Tension on trailing part of yarn (cN) | Tension on leading part of yarn (cN) | Yarn Speed (m/min) | Connection Sufficiently strong |
|---|---|---|---|---|---|---|
| 1 | Main yarn | 3360 | 800 | 1300 | 390 | Yes |
| | First yarn | 3360 | 800 | 1400 | 440 | |
| 2 | Main yarn | 3360 | 800 | 1300 | 390 | Yes |
| | First yarn | 3360 | 800 | 1400 | 450 | |
| 3 | Main yarn | 3360 | 800 | 1300 | 390 | Yes |
| | First yarn | 3360 | 800 | 1400 | 460 | |
| 4 | Main yarn | 3360 | 800 | 1300 | 400 | Yes |
| | First yarn | 3360 | 800 | 1400 | 400 | |
| 5 | Main yarn | 3360 | 800 | 1300 | 400 | Yes |
| | First yarn | 10080 | 800 | 1400 | 400 | |
| 6 | Main yarn | 840 | 300 | 600 | 400 | Yes |
| | First yarn | 840 | 300 | 600 | 420 | |
| 7 | Main yarn | 840 | 300 | 600 | 400 | Yes |
| | First yarn | 840 | 300 | 600 | 440 | |
| 8 | Main yarn | 840 | 300 | 600 | 400 | Yes |
| | First yarn | 840 | 300 | 600 | 460 | |

The results in Table 1 show that even for wet yarns having very high yarn counts of up 10080 dtex it is possible to obtain a sufficiently strong connection between the first yarn and the main yarn in order for the first yarn to be guided by the main yarn to the winder at the end of the spinning line.

The invention claimed is:

1. A method of entangling a first yarn into a moving main yarn, comprising:

aligning the first yarn substantially parallel to the main yarn, and subsequently directing a fluid jet onto the first yarn for separating filaments and/or groups of filaments in the first yarn from each other and to intermingle filaments and/or groups of filaments of the first yarn with filaments and/or groups of filaments of the main yarn to form mechanical friction points between filaments and/or groups of filaments from the first yarn and the main yarn, thereby entangling the first yarn into the moving main yarn, wherein the fluid jet is directed onto the first yarn at least at sonic speed, and a speed of the main yarn before and after the entangling is essentially the same.

2. The method according to claim 1, wherein a second yarn is aligned substantially parallel to the main yarn and the fluid jet forms mechanical friction points between filaments and/or groups of filaments from the first yarn, the second yarn and the main yarn.

3. The method according to claim 1, wherein the first yarn moves at a speed of at least at a speed of 105% of the speed of the main yarn.

4. The method according to claim 1, wherein the first yarn comprises at least 10 wt. % of a liquid based on a weight of polymer in the first yarn.

5. The method according to claim 1, wherein tension on the first yarn is 95% or less of tension on the main yarn.

6. The method according to claim 1, wherein the fluid jet is directed onto the first yarn for a time period of 0.3 seconds or less.

7. The method according to claim 1, wherein the fluid jet is reflected, after having intermingled filaments and/or groups of filaments of the first yarn with filaments and/or groups of filaments of the main yarn, such that the fluid jet is redirected onto the main yarn for separating filaments and/or groups of filaments in the main yarn from each other and to intermingle filaments and/or groups of filaments of the main yarn with filaments and/or groups of filaments of the first yarn to form mechanical friction points between filaments and/or groups of filaments from the main yarn and the first yarn.

8. An apparatus for entangling a first yarn into a moving main yarn comprising:

an aligning unit that aligns the first yarn substantially parallel to the main yarn; and a generating unit that generates a fluid jet directed onto the first yarn for separating filaments and/or groups of filaments in the first yarn from each other and to intermingle filaments and/or groups of filaments of the first yarn with filaments and/or groups of filaments of the main yarn to form mechanical friction points between filaments and/or groups of filaments from the first yarn and the main yarn, thereby entangling the first yarn into the moving main yarn;

wherein the generating unit generates the fluid jet at least at sonic speed when in use, and a speed of the main yarn before and after the entangling is essentially the same.

9. The apparatus for entangling a first yarn into a main yarn according to claim 8, wherein the generating unit comprises a receptacle for containing a compressed fluid and a valve for releasing a pulse of compressed fluid in the direction of the first yarn.

10. The apparatus for entangling a first yarn into a main yarn according to claim 9, wherein the receptacle is located within 1 m from the first yarn.

11. The apparatus for entangling a first yarn into a main yarn according to claim 9, further comprising a reflecting unit that reflects the fluid jet after having intermingled filaments and/or groups of filaments of the first yarn with filaments and/or groups of filaments of the main yarn.

12. The apparatus for entangling a first yarn into a main yarn according to claim 8, wherein the aligning unit is capable of aligning the first yarn at a distance of less than 10 mm from the main yarn.

13. The apparatus for entangling a first yarn into a main yarn according to claim 8, further comprising a first adjusting unit that adjusts the tension on the main yarn.

14. The apparatus for entangling a first yarn into a main yarn according to claim 8, further comprising an adjusting unit that adjusts the tension on the first yarn.

15. The apparatus for entangling a first yarn into a main yarn according to claim 8, further comprising a cutting unit that cuts off the leading part of the first yarn.

* * * * *